US007935261B2

(12) United States Patent
Jones et al.

(10) Patent No.: US 7,935,261 B2
(45) **Date of Patent: *May 3, 2011**

(54) PROCESS FOR TREATING WASTE DRILLING MUD

(75) Inventors: Thomas P. Jones, Little Rock, AR (US); Richard T. Davis, Little Rock, AR (US); Charles R. Richesin, Little Rock, AR (US)

(73) Assignee: Arkansas Reclamation Company, LLC, Little Rock, AR (US)

( * ) Notice: Subject to any disclaimer, the term of this patent is extended or adjusted under 35 U.S.C. 154(b) by 195 days.

This patent is subject to a terminal disclaimer.

(21) Appl. No.: 12/313,750

(22) Filed: Nov. 24, 2008

(65) Prior Publication Data

US 2010/0126936 A1 May 27, 2010

(51) Int. Cl.
*B01D 17/04* (2006.01)

(52) U.S. Cl. ..... 210/708; 175/66; 210/710; 210/718; 210/721; 210/724; 210/737; 210/774; 210/787; 210/806

(58) Field of Classification Search ..... 175/66
See application file for complete search history.

(56) References Cited

U.S. PATENT DOCUMENTS 2,919,898 A 1/1960 Marwil et al.
3,713,499 A 1/1973 Arscott
3,860,019 A 1/1975 Teague
4,181,494 A 1/1980 Kimberley
4,297,225 A 10/1981 Hartley
4,394,140 A * 7/1983 Liljestrand ..... 96/188
4,482,459 A 11/1984 Shiver
4,634,533 A * 1/1987 Somerville et al. ..... 210/722
(Continued)

FOREIGN PATENT DOCUMENTS

EP 334944 10/1989
(Continued)

OTHER PUBLICATIONS

WIPO, "International Search Report and Written Opinion of the International Searching Authority," Jun. 24, 2010.

*Primary Examiner* — Peter A Hruskoci
(74) *Attorney, Agent, or Firm* — Bradley Arant Boult Cummings, LLP; Nicholas J. Landau

(57) ABSTRACT

A method is provided of recycling and cleaning up oil-based waste drilling mud and cuttings contaminated with oil-based waste drilling mud. A facility for performing the method is also provided. The method includes removing the coarse solids from the mud, breaking the emulsion, separating the hydrophobic phase from the water phase and the solid phase, vaporizing all residual oil and water from the solids, and burning off the vaporized oil. The method produces a solid "soil" product that is free from oil contamination, an oil product that is fit for reuse, and clean air emissions. A thermal desorber can be used to efficiently vaporize the oil at low temperature. Optionally the water fraction of the mud can be vaporized, solutes and salts can be captured as evaporite and then be mixed with the soil product. The method has the unique advantage of producing no persistent hazardous waste. The method has the further advantage of requiring no external input of energy if the reclaimed oil is used to provide energy for the process. The method has the further advantage of recycling portions of the drilling mud that would otherwise be subject to disposal.

8 Claims, 2 Drawing Sheets

U.S. PATENT DOCUMENTS

| | | | | |
|---|---|---|---|---|
| 4,670,139 | A | 6/1987 | Spruiell | |
| 4,696,353 | A | 9/1987 | Elmquist | |
| 4,725,362 | A * | 2/1988 | Dugat | 210/710 |
| 4,804,461 | A | 2/1989 | Heinrich | |
| 4,836,302 | A | 6/1989 | Heilhecker | |
| 4,856,580 | A * | 8/1989 | Ley | 165/87 |
| 4,872,949 | A * | 10/1989 | Wilwerding | 159/47.3 |
| 5,005,655 | A | 4/1991 | Stokke | |
| 5,053,082 | A | 10/1991 | Flanigan | |
| 5,080,721 | A | 1/1992 | Flanigan | |
| 5,090,498 | A | 2/1992 | Hamill | |
| 5,132,025 | A | 7/1992 | Hays | |
| 5,454,957 | A | 10/1995 | Roff, Jr. | |
| 5,570,749 | A | 11/1996 | Reed | |
| 5,582,727 | A | 12/1996 | Foster | |
| 6,132,630 | A * | 10/2000 | Briant et al. | 210/774 |
| 6,345,672 | B1 | 2/2002 | Dietzen | |
| 6,391,195 | B1 | 5/2002 | Layton | |
| 6,585,115 | B1 | 7/2003 | Reddoch | |
| 6,881,349 | B2 | 4/2005 | Mueller | |
| 6,973,980 | B2 | 12/2005 | Stepenoff | |
| 7,300,578 | B2 | 11/2007 | Mueller | |
| 7,306,057 | B2 * | 12/2007 | Strong et al. | 175/66 |
| 7,678,201 | B2 * | 3/2010 | Cobb | 134/40 |
| 2002/0074269 | A1 | 6/2002 | Hensley | |
| 2003/0164235 | A1 | 9/2003 | Leeson | |
| 2003/0222026 | A1 | 12/2003 | Carey | |
| 2004/0094483 | A1 | 5/2004 | Mueller | |
| 2004/0192980 | A1 | 9/2004 | Appel | |
| 2005/0016773 | A1 | 1/2005 | Stepenoff | |
| 2005/0092671 | A1 | 5/2005 | Mueller | |
| 2005/0145418 | A1 | 7/2005 | Cordova | |
| 2007/0125716 | A1 | 6/2007 | Procter | |
| 2008/0119683 | A1 | 5/2008 | O'Ham | |

FOREIGN PATENT DOCUMENTS

| | | |
|---|---|---|
| EP | 01083296 | 10/2004 |
| GB | 2238730 | 6/1991 |
| GB | 2338733 | 12/1999 |
| GB | 2349656 | 11/2000 |
| JP | 2001-065281 | 3/2001 |
| WO | 82001737 | 5/1982 |
| WO | 8902774 | 4/1989 |
| WO | 8909091 | 10/1989 |
| WO | 9009507 | 8/1990 |
| WO | 9910068 | 3/1999 |
| WO | 9964356 | 12/1999 |
| WO | 0145818 | 6/2001 |
| WO | 0220691 | 3/2002 |

* cited by examiner

PROCESS FOR TREATING WASTE DRILLING MUD

FIELD OF THE DISCLOSURE

The field of the disclosure is environmental protection. More specifically, the field of the disclosure is technology directed to the treatment and recycling of organic compounds from drilling muds. Additionally, the field of the disclosure is technology directed to the treatment and recycling of saline groundwater from used drilling muds.

BACKGROUND

Drilling through rock generally requires the use of some type of fluid to clear cuttings from the bore hole formed by the drill. In some applications, the drilling fluid can be as simple as compressed air. However, when drilling is conducted to tap fossil fuel resources, the drilling fluid used is usually a "drilling mud." Drilling muds are generally placed in three categories, depending on the major fluid component: water-based, oil-based, and pneumatic. In the natural gas industry, oil-based muds predominate.

Oil-based muds serve several functions during drilling: removing cuttings from the well, suspending the cuttings, controlling formation pressure, sealing permeable formations, stabilizing the wellbore, reducing formation damage, cooling the drill, lubricating the drill, transmitting hydraulic energy to tools and the bit, and reducing corrosion. Oil-based drilling muds typically comprise a hydrocarbon-water emulsion, an emulsifier, and clay. Bentonite is the most widely used clay in drilling muds, although other clays can be used. Other ingredients are often present. Barite, for example, is often used as a weighting agent to increase the outward hydrostatic pressure in the borehole.

Typically, used drilling mud will be recirculated through a drill and borehole at the drill site. The larger cuttings are removed from the mud prior to recirculation. This is generally achieved by running the used mud over a shaker screen. This collects the drill cuttings, which are mixed with drilling mud and groundwater. The waste drilling mud and the cuttings are then subject to disposal, either with or without some form of treatment. In some situations an unused drill mud must be subject to disposal. This can occur for example if a mud is stored for too long, and loses some of its beneficial properties. All such muds, used or unused, are referred to in this disclosure as "waste drilling mud."

Disposal of waste drilling muds is a major problem in the art. Diesel is commonly used as an oil in drilling muds. Diesel poses environmental hazards, so diesel-based mud must be deposited in special landfills constructed with an impermeable lining. This is expensive, and the possibility remains that the hazardous components of the mud could leak from the landfill, damaging the environment and exposing all parties involved to toxic cleanup liability. Used drilling muds may also contain groundwater with high salt concentrations. Such saline water can also be environmentally harmful if not disposed of properly; its disposal is similarly expensive and can constitute a continuing threat to the environment with attendant legal liabilities. The task of disposal of drilling muds is complicated by the complex, multi-phase nature of the muds, which makes it difficult to isolate the hazardous components to reduce disposal volumes.

Even when the bulk oil fraction of a drilling mud is separated and purified, residual organic compounds often remain tightly associated with solids in the mud (either the clay or drill cuttings), requiring disposal as a hazardous substance.

Methods for completely removing hydrocarbons from the solid phase, such as steam distillation, are energy-intensive and inefficient. Solvent-based methods of hydrocarbon separation from the solid phase merely compound the problem by the introduction of hazardous solvent. Combustion of the liquid hydrocarbon in emulsion requires very high operating temperatures and can be a source of air pollution. Combustion of liquid hydrocarbon when mixed with the solid phase is problematic, as it requires the facility be licensed as an incinerator.

If the hydrocarbon fraction is effectively removed, the remaining components of most waste drilling muds (water, clay, and possibly cuttings) are not hazardous, and may be disposed of without special protective measures or reused for muds or other purposes. When waste mud contains saline water, disposal of the aqueous fraction may pose a problem. Although salt concentrations in "saline" groundwaters are low compared to marine waters, they are often sufficiently high to damage soils and bodies of freshwater. Saline water may be disposed of by storage in a lagoon, in which the water slowly evaporates and the salt precipitates. Although this method greatly reduces the volume of the waste material, the concentrated salt evaporite that remains can be highly damaging to soil and groundwater, and requires either alternative disposal or further treatment. Another method of disposal is permanent storage of the saline water in an impermeable landfill. This method is expensive, may result in leaks, and is not available in every location.

Consequently, there is a long-felt need in the art for a method of waste drilling mud disposal that requires no disposal of hydrocarbons and creates no persistent pollution. There is a further long-felt need in the art for a method of waste drilling mud disposal that requires no disposal of saline water. There is a further long-felt need in the art for a method of treatment of waste drilling mud that requires no disposal of hazardous pollutants. There is a further long-felt need in the art for a method of cost-effective diesel recycling from drilling mud.

SUMMARY

The disclosure teaches a method of treating waste drilling muds that produces substantially no persistent pollution, its only products being either non-hazardous or fully reusable. The method generally includes a crude separation of larger solid particles from the liquid phase, the separation of the aqueous and oil sub-phases of the liquid phase, storage of the hydrophobic phase as a reusable oil product (such as diesel), removal of substantially all organics from the solid particles through vaporization and optionally combustion, substantially complete combustion of all of the vaporized organics, and emission of the clean combustion products. The only products of the method are water, a clean solid product, flue gasses, and reusable diesel product. The solid product and flue gasses are substantially free of pollutants, and the diesel product can be safely reused, for example in new drilling mud or as a fuel. The methods disclosed serve the additional purposes of recycling drilling muds, recycling diesel fuel, disposing of saline water, and preventing pollution.

Optionally the method also includes disposing of the aqueous phase through vaporization. Some solutes in the aqueous phase, notably salts, will form an evaporite upon vaporization of the aqueous phase. The evaporite can then be captured and disposed of for example by dilution in the clean solid product. The water vapor can then be harmlessly emitted to the atmosphere.

The disclosure also teaches a method of treating a waste drilling mud. Some embodiments of the method are a method of treating a waste drilling mud comprising a bulk emulsion and a drilling mud solid, wherein the bulk emulsion comprises a hydrophobic phase and an aqueous phase, the method comprising: separating a fraction of the drilling mud solid from the waste drilling mud, the fraction comprising a residual organic phase; demulsifying the bulk emulsion, to form a demulsified hydrophobic phase and a demulsified aqueous phase; separating the demulsified hydrophobic phase from the demulsified aqueous phase, to create an aqueous product and an oil product, wherein the oil product is suitable for reuse; removing substantially all the residual organic phase from the solid feed material, to create an organic vapor and a first clean solid product, removing the residual organic phase comprising vaporizing the residual organic phase; wherein the first clean solid product is substantially free from organic pollutants; combusting substantially all of the organic vapor under conditions sufficient to ensure substantially complete combustion, to create a clean gaseous product; and discharging the clean gaseous product to create a clean gaseous discharge 45, wherein the clean gaseous discharge 45 is substantially free from solids, organics, or pollutants.

The disclosure also teaches a method of producing a reusable oil product from a waste drilling mud. One embodiment of the method is a method of producing a reusable oil product from a waste drilling mud, the waste drilling mud comprising a bulk emulsion and a drilling mud solid, the bulk emulsion comprising an oil and water, the method comprising: removing a first fraction of the drilling mud solids, the first fraction comprising particles above a first pre-determined diameter; removing a second fraction of the drilling mud solids, the second fraction comprising particles above a second predetermined diameter; adjusting the viscosity of the drilling mud to below about 45 seconds Marsh funnel at 150° F.; demulsifying the bulk emulsion to create a hydrophobic phase and an aqueous phase in the waste drilling mud; at least partially separating the hydrophobic phase from the aqueous phase; and removing a third fraction of drilling mud solids to create a reusable oil product, the third fraction comprising particles above a third diameter.

The disclosure also teaches a method of disposing of a saline groundwater of a waste drilling mud. Some embodiments of the method are a method of disposing of a saline groundwater of a waste drilling mud, the waste drilling mud comprising a bulk emulsion and a drilling mud solid, the bulk emulsion comprising an oil and the saline groundwater, the method comprising: removing a first fraction of the drilling mud solids, the first fraction comprising particles above a first pre-determined diameter; removing a second fraction of the drilling mud solids, the second fraction comprising particles above a second predetermined diameter; adjusting the viscosity of the drilling mud to below about 45 seconds Marsh funnel at 150° F.; demulsifying the emulsion to create a hydrophobic phase and an aqueous phase; at least partially separating the hydrophobic phase from the aqueous phase to form a reusable oil product; and removing a third fraction of drilling mud solids, the third fraction comprising particles above a third diameter; vaporizing the aqueous phase to form a water vapor and an evaporite; capturing the evaporite; and releasing the water vapor substantially free from pollutants.

The disclosure also provides a method of removing organic pollutants from a drilling mud solid. Some embodiments of the method comprise: obtaining a waste drilling mud comprising a bulk emulsion and the drilling mud solid, the bulk emulsion comprising an oil and water; removing a first solid fraction of the drilling mud solid from the waste drilling mud, the first solid fraction comprising a residual organic phase; and removing substantially all of the residual organic phase from the first solid fraction by a removal process comprising vaporizing the residual organic phase to create an organic vapor.

The disclosure also teaches a facility for treating waste drilling muds. Some embodiments of the facility comprise: a dryer; a three phase centrifuge linked to receive material from the dryer; an oil product collection tank linked to receive material from the three phase centrifuge; a water conduit linked to receive material from the three phase centrifuge; a low-temperature thermal desorber; an oxidizer linked to receive material from the low-temperature thermal desorber, the oxidizer comprising an oxidant inlet and a fuel inlet; a baghouse linked to receive material from the oxidizer, the baghouse comprising a bag filter; and a flue linked to receive material from the baghouse.

DETAILED DESCRIPTION

Figure 1:
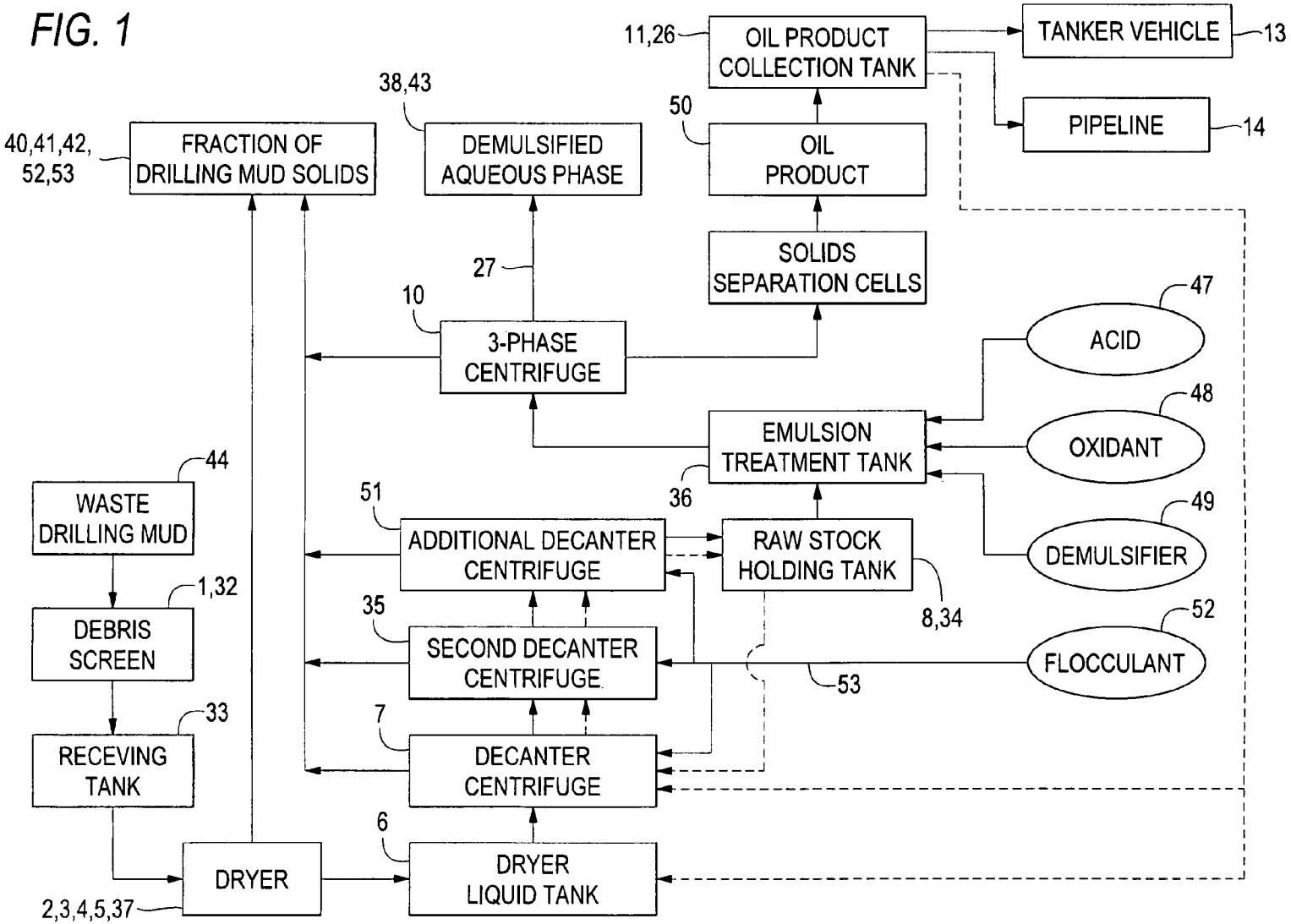
FIG. 1. Schematic of an embodiment of the facility showing elements of the early stages of processing, wherein the waste drilling mud is separated into an oil product, a demulsified aqueous phase, and a solid fraction.

The foregoing description illustrates and describes the methods, apparatuses, and other teachings of the present disclosure. Additionally, the disclosure shows and describes only certain embodiments of the methods, apparatuses, and other teachings disclosed, but, as mentioned above, it is to be understood that the teachings of the present disclosure are capable of use in various other combinations, modifications, and environments and are capable of changes or modifications within the scope of the teachings as expressed herein, commensurate with the skill and/or knowledge of a person having ordinary skill in the relevant art. The embodiments described are further intended to explain certain best modes known of practicing the methods, apparatuses, and other teachings of the present disclosure and to enable others skilled in the art to utilize the teachings of the present disclosure in such, or other, embodiments and with the various modifications required by the particular applications or uses. Accordingly, the methods and other teachings of the present disclosure are not intended to limit the exact embodiments and examples disclosed herein.

A. Definitions

All terms used in this disclosure should be construed as encompassing both the singular and the plural form of the term, unless specified otherwise.

The term "including" as used herein is non-exclusive, and can be read as synonymous with "including but not limited to."

The term "cutting" as used herein refers to mineral material that is dislodged from rock strata during drilling.

The term "aqueous phase" as used herein refers to a liquid having a relatively high polarity and being substantially immiscible with oils; the aqueous phase may exist as a mixture (including an emulsion) with oils or other non-aqueous liquids.

The term "water" as used herein refers to liquid $H_2O$ substantially free of any immiscible solvents, and which may or may not contain solutes.

The term "pollutant" as used herein refers to any substance the release of which is either legally regulated or is generally known to be harmful to human health and the environment, either directly through toxic effects or indirectly; whether a substance is a pollutant is partially determined by extrinsic properties, such as the amount of the substance.

The term "linked to receive material from" indicates an element or structure arranged such that a material can be transported from another element or structure. Such transport can be suitable for liquids, solids, gasses, or mixtures thereof. Elements so linked may be connected by pipes, channels, conduits, conveyors, or any other means known in the art. The linkage need not be direct, and additional structures or elements may intervene between the linked elements.

The term "linked to transmit material to" indicates an element or structure arranged such that a material can be transported to another element or structure. Such transport can be suitable for liquids, solids, gasses, or mixtures thereof. Elements so linked may be connected by pipes, channels, conduits, conveyors, or any other means known in the art. The linkage need not be direct, and additional structures or elements may intervene between the linked elements.

The term "waste drilling mud" indicates a drilling mud intended for disposal, whether used or unused.

B. Waste Drilling Mud Processing Facility

The disclosure provides facilities for providing any of the methods disclosed herein. The disclosure provides a waste drilling mud processing facility comprising: a dryer 2, a three phase centrifuge 10 linked to receive material from the dryer 2, an oil product 50 collection tank 26 linked to receive material from the three phase centrifuge 10, a water conduit 27 linked to receive material from the three phase centrifuge 10, a low-temperature thermal desorber 15, an oxidizer 21 comprising an oxidant inlet 28 and a fuel inlet 29 linked to receive material from the low-temperature thermal desorber 15, a baghouse 24 comprising a baghouse filter 25 linked to receive material from the oxidizer 21, and a flue linked to receive material from the baghouse 24. Some embodiments of the facility comprise at least one of the following: a debris screen 32 linked to transmit material to the dryer 2; a receiving tank 33 linked to transmit material to the dryer 2; a dryer liquid tank 6 linked to receive material from the dryer 2 and linked to transmit material to the three phase centrifuge 10; a decanter centrifuge 7 linked to receive material from the dryer 2 and linked to transmit material to the three phase centrifuge 10; a raw stock holding tank 34 linked to receive material from the dryer 2 and linked to transmit material to the three phase centrifuge 10; a soil conditioner 18 linked to receive material from the thermal desorber 15; a cyclonic separator 20 linked to receive material from the low temperature thermal desorber 15 and linked to transmit material to the oxidizer 21; and a quench chamber 22 linked to receive material from the oxidizer 21 and linked to transmit material to the baghouse 24. Each of the elements may be linked to receive material from or transmit material to other elements, depending on their configuration.

FIG. 1 partially illustrates one such embodiment of the facility, showing the elements involved in the separation of the waste drilling mud 44 into a solid fraction 40, 41, 42, and demulsified aqueous phase 43 and an oil product 50. In the illustrated embodiment the waste drilling mud 44 is passed through a debris screen 32 into a receiving tank 33. Waste drilling mud is then transported to the dryer 2, where a fraction of the drilling mud solids 40 is removed. The remaining waste drilling mud 44 is then transported to the dryer liquid tank 6, and then to a decanter centrifuge 7. The decanter centrifuge removes a second fraction 41 of drilling mud solids. The remaining waste drilling mud 44 is then transported to a second decanter centrifuge 35. The second decanter centrifuge 35 removes a third fraction 52 of drilling mud solids. The remaining waste drilling mud 44 is then transported to an additional decanter centrifuge 51. The additional decanter centrifuge 51 removes an additional fraction 42 of drilling mud solids. The remaining waste drilling mud 44 (now referred to as "raw stock") is transported to a raw stock holding tank 34. Depending on the viscosity of the waste drilling mud 44, the waste drilling mud 44 is then transported to one of an emulsion treatment tank 36 or the decanter centrifuge 7. Agents are added to demulsify the emulsion, including an acid 47, an oxidant 48, and a demulsifier 49. The waste drilling mud 44 is then transported to a three-phase centrifuge 10. The three-phase centrifuge 10 separates the waste drilling mud 44 into three components: a fourth fraction 53 of drilling mud solids, a demulsified aqueous phase 43, and an oil product 50. The demulsified aqueous phase 43 is transported to a reservoir 38. The oil product 50 is transported to one or more solids separation cells and then to an oil product collection tank 26. Oil product 50 in the oil product collection tank 26 can then be distributed by means of a pipeline 14 or a tanker vehicle 13.

Figure 2:
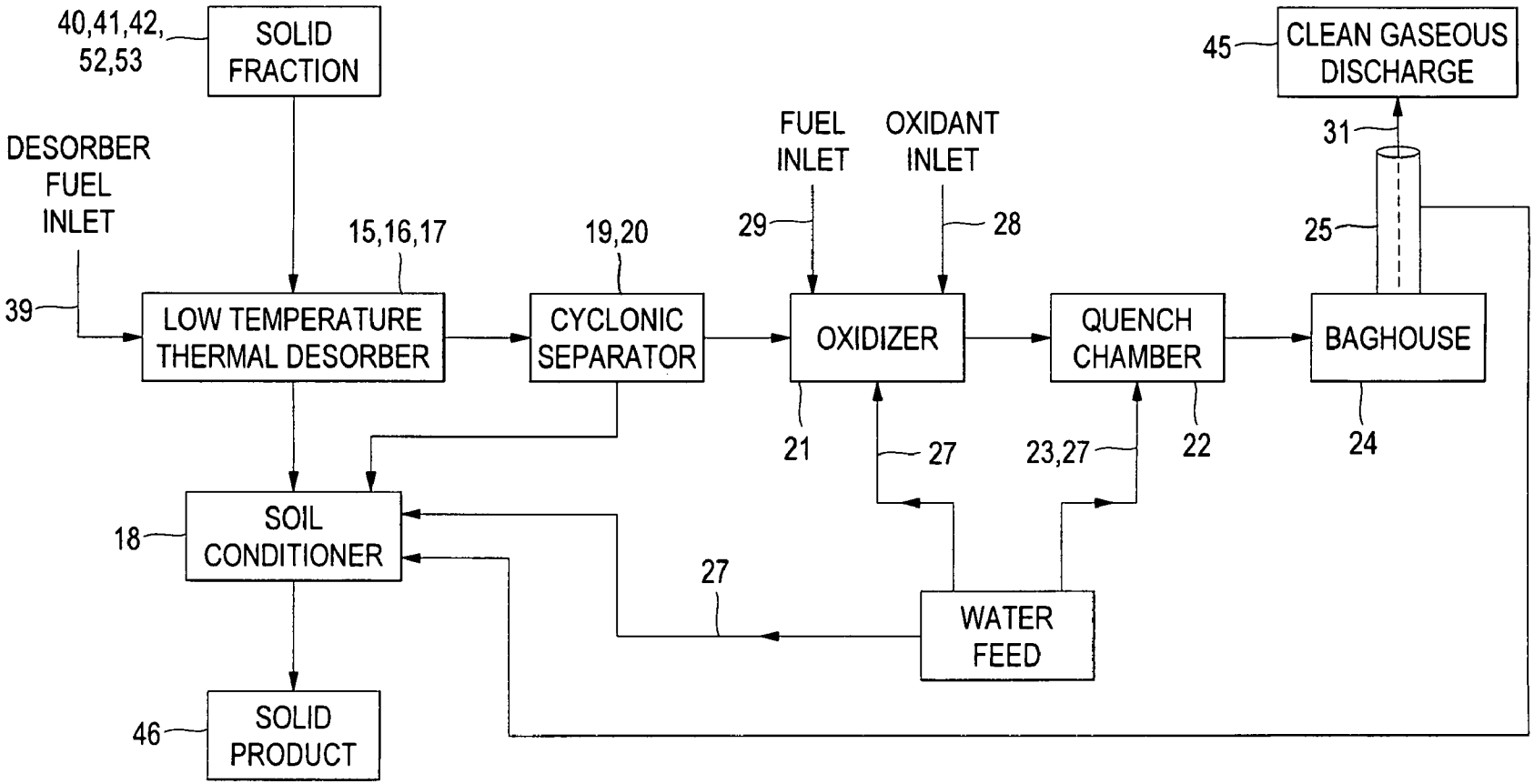
FIG. 2. Schematic of an embodiment of the facility showing elements of the later stages of processing, wherein the solid fraction is processed to form a solid product and a clean gaseous discharge. Wastewater may also be treated.

FIG. 2 partially illustrates the later elements of the embodiment of the facility. The solid fractions 40-42 52 53 are introduced to a direct-fired counter-current low temperature thermal desorber 16 having a desorber fuel inlet 39. Any residual organic fraction is vaporized and run through a dual cyclone 19. The remaining solids are fed into a soil conditioner 18 and combined with water, to form the solid product 46. Any solids removed by the dual cyclone 19 are also fed into the soil conditioner 18. The vaporized organics that pass through the dual cyclone 19 are transported into an oxidizer 21 having a fuel inlet 29, an oxidant inlet 28, and optionally a water inlet 27. The organic vapor is completely combusted, and the hot products of combustion are fed into a quench chamber 22 having a water inlet 23, whereby cooling water is sprayed into the quench chamber 22. The cooled gasses then pass into a baghouse 24 and through a bag filter 25. Any solids retained by the bag filter 25 are fed into the soil conditioner 18. The cooled gasses are emitted through a flue 31 to form a clean gaseous discharge 45.

Some embodiments of the facility further comprise a debris screen 32; a receiving tank 33 linked to transmit material to the dryer and linked to receive material from the debris screen 32; a dryer liquid tank 6 linked to receive material from the dryer 2; a decanter centrifuge 7 linked to receive material from the dryer liquid tank 6; a second decanter centrifuge 35 linked to receive material from the decanter centrifuge 7; a raw stock holding tank 34 linked to receive material from the second decanter centrifuge 35; an emulsion treatment tank 36 linked to receive material from the raw stock holding tank 34 and linked to transmit material to the three phase centrifuge 10; a soil conditioner 18 linked to receive material from the thermal desorber 15; a cyclonic separator 20 linked to receive material from the thermal desorber 15 and linked to transmit material to the oxidizer 21; and a quench chamber 22 linked to receive material from the oxidizer 21 and linked to transmit material to the baghouse 24. Some embodiments of the facility further comprise an additional decanter centrifuge 51 linked to receive material from at least one of the dryer 2, the liquid dryer tank 6, the decanter centrifuge 7, and the second decanter centrifuge 35.

In some embodiments of the facility, a flocculant inlet 53, feeds flocculant 52 into at least one of the additional decanter centrifuge 51, the decanter centrifuge 7, and the second decanter centrifuge 35.

As explained herein, the dryer 2 may be any dryer known in the art to be suitable for separating solids from waste drilling mud, high-viscosity liquids, emulsions, or oils including a processing centrifugal dryer 37 or a vertical centrifugal dryer 4.

The three phase centrifuge 10 linked to receive material from the dryer 2 can be any such apparatus known to those skilled in the art suitable for separating an hydrophobic phase from an aqueous phase and solids of up to a predetermined diameter.

The oil product 50 collection tank 26 linked to receive material from the three phase centrifuge 10 can be any suitable vessel or tank.

The water conduit 27 linked to receive material from the three phase centrifuge 10 may be any suitable conduit, for example a pipe. The water conduit 27 may be linked to transmit water to a reservoir 38. In some embodiments of the facility, the water conduit 27 is linked to transmit water to at least one of the following: the thermal desorber 15, the soil conditioner 18, the oxidizer 21, and the quench chamber 22.

The low-temperature thermal desorber 15 can be of any type known to those skilled in the art, as explained herein, including a direct-fired countercurrent rotary dryer 16. The low-temperature thermal desorber 15 may comprise a desorber fuel inlet 39. In some embodiments of the facility the fuel inlet 39 of the desorber is linked to receive material from the oil product 50 collection tank 26 or linked to receive the hydrophobic phase (or demulsified hydrophobic phase) from the three-phase centrifuge 10.

The oxidizer 21 linked to receive material from the low-temperature thermal desorber 15 comprises an oxidant inlet 28 and a fuel inlet 29. As explained elsewhere herein, the oxidizer 21 must be capable of performing under operating conditions to assure substantially complete combustion of the organic vapor.

The quench chamber 22 may be configured to allow the clean gaseous product to expand and undergo expansive cooling. In some embodiments of the facility the quench chamber 22 is linked to receive quench water from the water conduit 27.

The soil conditioner 18 may be linked to receive conditioning water from the water conduit 27.

The baghouse 24 linked to receive material from the oxidizer 21 comprises a bag filter 30. The baghouse 24 can be of any design understood by those skilled in the art.

C. Methods of Treating Waste Drilling Mud

The instant disclosure provides methods for processing a waste drilling mud 44. The waste drilling mud 44 may be used or unused. A used drilling mud may comprise drilling mud solids, such as a plurality of drill cuttings, clay, and barite. In fact, a used drilling mud may comprise over 50% drill cuttings by weight, or be nearly entirely drill cuttings by weight. Such a composition is still referred to as a drilling mud. Some, but not all, drilling muds contemplated by this disclosure comprise at least one of the following: an oil, water, oil and water in a bulk emulsion, an emulsifier, solutes, and solids.

The drilling mud contemplated is an oil-based drilling mud. The oil may be a fuel oil. If the oil is a fuel oil, it can be any class of fuel oil, including numbers 1, 2, 3, 4, 5 or 6 fuel oil (alone or in any combination). In some embodiments the fuel oil is a bunker fuel or a heating oil. In some embodiments, the oil is diesel. Oil-based drilling muds based on diesel are commonly based on petroleum derived diesel ("petrodiesel"), but a mud based on diesel derived from plant oils ("biodiesel") will work in some embodiments of the method also. The oil may be present in an emulsion or a "reverse emulsion" (in which an aqueous phase is emulsified within a hydrophobic phase).

Some embodiments of the methods and facilities of this disclosure can be applied to a used drilling mud that also contains drilling mud solids other than cuttings. Such drilling mud solids may include a clay; that clay may be a Bentonite, another clay, or a combination of clays. Barite may also be included.

If the used drilling mud contains drilling mud solids (cuttings or otherwise) with high organic content, additional treatment may be required to achieve the desired separation and cleanup of the different fractions of the used drilling mud. If the drilling mud solids contain inorganic pollutants, such as radionuclides or heavy metals, additional treatment may be necessary to adequately address the inorganic pollutants. Ideally the used drilling mud solids are free from inorganic pollutants.

Some embodiments of the methods and facilities of this disclosure can be applied to a used drilling mud that also contains water, including water in an emulsion or a reverse emulsion. The water is also referred to as an "aqueous phase." The water may be present at any concentration. The water may contain solutes at any concentrations. In some embodiments, the water contains salts. The water may contain salts up to their saturation concentrations. In some drilling muds, the salts will be salts common in groundwater. Such groundwater salts include hypochlorides, chlorides, chlorates, perchlorates, sulfates, sulfites, sulfides, nitrates, nitrites, phosphates, carbonates, bicarbonates, carbides, borates, oxides, fluorides, silicates, arsenates, arsenides, selenates, selenides, bromates, bromides, and iodides. These may be present in high concentrations in old groundwaters. For example, chloride may be present at up to about 3000 ppm in certain groundwaters, or up to exactly 3000 ppm. The water may also contain dissolved organics. Ideally the water does not contain significant organic solutes.

Some embodiments of the methods and facilities of this disclosure can be applied to a used drilling mud that also contains an emulsifier. Embodiments of the methods and facilities may be applied generally to mud containing any emulsifier known in the art, including organic emulsifiers.

1. Screening

Certain embodiments of the method comprise screening the waste drilling mud 44 to remove any debris. In this context "debris" refers to trash or other large contaminating objects present in the waste drilling mud 44, and does not include drilling mud solids. The debris can be removed with a coarse screen 1 as familiar to those skilled in the art. After screening, the waste drilling mud 44 can be conveyed directly to a dryer 2 or it can be held in a receiving tank 3 prior to drying.

2. Drying

Certain embodiments of the method include separating a fraction of the drilling mud solid 40 from the waste drilling mud 44, the fraction 40 comprising particles above a predetermined diameter, the fraction further comprising a residual organic phase ("drying"). The separation may be achieved by use of a dryer 2. Any dryer known in the art to be suitable for separating solids from waste drilling mud 44, high-viscosity liquids, emulsions, or oils may be used. Such dryers include for example a centrifugal dryer 3. In some embodiments, the dryer is a vertical centrifugal dryer 4, or a processing centrifuge 5. The dryer 2 may be operated to effect the separation of a fraction 40 of the drilling mud solid from the waste drilling mud 44, wherein the fraction 40 of the drilling mud solid comprises particles below a first predetermined diameter. The first predetermined diameter may be any diameter of solid. In some embodiments of the method, the first predetermined diameter is about 15/1000", or exactly 15/1000" (3.81 mm). In some embodiments of the method, the first predetermined diameter is from zero to about 15/1000", or from zero to exactly 15/1000".

The remainder of the waste drilling mud 44 will have a reduced solids concentration at this point. In some embodiments of the method, the waste drilling mud 44 after separating a fraction of the drilling mud solid 40 from the waste drilling mud 44 has a solids concentration of one or more of the following: 10-40%, 15-35%, 20-30%, 25%, or about these values.

Subsequent to drying, the remainder of the waste drilling mud 44 may be conveyed to a dryer liquid tank 6. If the remainder of the waste drilling mud 44 is conveyed to a dryer liquid tank 6, the waste drilling mud 44 can then be conveyed to subsequent steps in the method.

3. De-Solidification

Some embodiments of the method comprise removing a second fraction 41 of the drilling mud solids, the second fraction 41 comprising particles above a second pre-determined diameter. In certain of these embodiments the second diameter is less than the first pre-determined diameter of the first separation step. In various embodiments of the method, the second pre-determined diameter is one or more of the following: 5-15 μm, 6-14 μm, 7-13 μm, 8-12 μm, 9-11 μm, 10 μm, and about these values.

In some embodiments of the method, the second fraction 41 is removed by centrifugation. In certain of these embodiments, the second fraction 41 is removed using a decanter centrifuge 7.

The process may be repeated on the remainder of the waste drilling mud 44, by removing a second fraction 41 of the drilling mud solids, the second fraction 41 comprising particles above a second pre-determined diameter. In some embodiments the third fraction 52 of the drilling mud solids is removed using a second decanter centrifuge 35. In various embodiments of the method, the second pre-determined diameter is one or more of the following: 5-15 μm, 6-14 μm, 7-13 μm, 8-12 μm, 9-11 μm, 10 μm, and about these values.

The process may be repeated on the remainder of the waste drilling mud 44, by removing additional fractions 42 of the drilling mud solids, the additional fractions 42 comprising particles above an additional pre-determined diameter. In some embodiments additional fractions 42 of the drilling mud solids are removed using one or more additional decanter centrifuges 51. In various embodiments of the method, the additional pre-determined diameter is one or more of the following: 5-15 μm, 6-14 μm, 7-13 μm, 8-12 μm, 9-11 μm, 10 μm, and about these values.

Some embodiments of the method comprise the addition of a flocculent 52 through a flocculant inlet 53. The flocculant promotes aggregation of solids in the waste drilling mud, and increases the efficiency of removal of the solids.

4. Preparation for Demulsification

The waste drilling mud 44 may be stored prior to demulsification in an agitator tank 8. The agitator tank 8 has the advantage of maintaining a homogeneous emulsion prior to demulsification. The agitator tank 8 may be heated to further aid in maintaining a homogeneous emulsion.

In some embodiments of the method, the viscosity of the waste drilling mud 44 is adjusted to a certain value or range prior to demulsification. Viscosity of the waste drilling mud 44 may be measured, and the waste drilling mud 44 viscosity adjusted if the viscosity is not within the certain range or at the certain value. The viscosity may be adjusted for example by diluting the waste drilling mud 44 and returning it to one of the earlier separation steps. The viscosity may also be adjusted by diluting the waste drilling mud 44 with diesel and carrying out the demulsification step.

More than one approach to viscosity adjustment may be employed in the method. In some embodiments of the method, the viscosity is adjusted by a certain method if it falls within one range, and adjusted by another method if it falls within another range. For example, if the viscosity is measured to be in a higher range, the viscosity may be adjusted by diluting the waste drilling mud 44 and returning it to one of the earlier separation steps. If the viscosity is measured to be in a middle range, the viscosity may be adjusted by diluting the waste drilling mud 44 and transmitting it to the demulsification step.

In some embodiments of the method, the waste drilling mud 44 is subjected to the demulsification step if its viscosity is below 45 seconds Marsh funnel at 150° F. or about this value. If the waste drilling mud's 44 viscosity is measured to be between about 45-50 seconds Marsh funnel at 150° F., the waste drilling mud 44 is diluted with diesel and then is subjected to the demulsification step. If the waste drilling mud's 44 viscosity is above about 50 seconds Marsh funnel at 150° F., the waste drilling mud 44 is diluted with diesel and returned to one of the previous separation steps.

5. Demulsification

Certain embodiments of the method include demulsifying the bulk emulsion, to form a demulsified hydrophobic phase and a demulsified aqueous phase 43. Demulsifying the bulk emulsion can be achieved by any means known in the art. Emulsions in drilling muds are idiosyncratic, based on the emulsifier used (if any) and the composition of the mud. When an organic emulsifier is used, the emulsion can be demulsified by any of the following alone or in combination: heating the emulsion, adjusting the pH of the emulsion, adding an oxidant to the emulsion, adding a de-emulsifier to the emulsion, and centrifuging the emulsion.

If the emulsion is heated in the process of demulsification, it can be heated to any temperature up to about the boiling temperature of the emulsion. In various embodiments of the method, the emulsion is heated to at least one of the following: 140-200° F., 150-190° F., 160-180° F., 165-175° F., 170° F., and about these values If the pH is adjusted in the process of demulsification, it can be acidified or made alkaline; typically the final pH will not be neutral if the pH is adjusted. Acidification below about pH 5 often increases the efficiency of demulsification when an organic emulsifier is used. In various embodiments of the method, the pH is adjusted to at least one of the following: 0.0-5.0, 4-6, 4.5-5.5, 4.5-5.3, 4.6, and about these values. The pH can be adjusted by the addition of any acid 47 or base. If the emulsion is acidified, some embodiments of the method comprise adding a strong acid 47 to the emulsion. Some embodiments of the method comprise adding a strong inorganic acid 47 to the emulsion. Some embodiments of the method comprise the addition of at least one of the following acids to the emulsion: hydrochloric acid, sulfuric acid, nitric acid, chromic acid, perchloric acid, hydroiodic acid, hydrobromic acid, fluoroantimonic acid, "magic acid" (an equimolar mixture of $HSO_3F$ and $SbF_5$), carborane superacid $H(CHB_{11}Cl_{11})$, fluorosulfuric acid, and triflic acid. Hydrochloric acid, for example, has the advantage of low cost and a high dissociation constant. In some embodiments of the method, a weak acid 47 is used to adjust the pH, although larger volumes are needed.

In some embodiments of the method, an oxidant 48 is added to achieve demulsification. The oxidant 48 functions to degrade an organic emulsifying agent, which then breaks the emulsion (alone or in combination with other means). Any oxidant can be used, but ideally the oxidant 48 will be chosen based on its oxidizing power, potential to contaminate the waste stream, cost, and possible side reactions. Commonly used oxidants include salts, oxides and acids of the following anions: hypochlorite, halogens, chlorite, chlorate, perchlorate, permanganate, chromate, dichromate, chromium trioxide, pyridinium chlorochromate, peroxide, Tollen's reagent, sulfoxides, and persulfate. Gasses such as nitrous oxide, ozone and $O_2$ are also excellent oxidants. Other potentially useful oxidants include osmium tetroxide, and nitric acid. For example, 1.5% sodium hypochlorite is an inexpensive and effective oxidant that aids in demulsification without the addition of unduly polluting hazardous material to the waste stream.

In some embodiments of the method, an additional demulsifier 49 is used, for example: acid-catalyzed phenol-formaldehyde resins, base-catalyzed phenol-formaldehyde resins, polyamines, di-epoxides, and polyols.

Some embodiments of the method comprise demulsifying the emulsion by centrifugation. This may involve centrifuging the emulsion in a two-phase centrifuge 9, in which case separation will occur between the demulsified hydrophobic phase and the demulsified aqueous phase 43. This may involve centrifuging the emulsion in a three-phase centrifuge 10, in which case separation will occur between the demulsified hydrophobic phase, the demulsified aqueous phase 43, and the solid in one step.

6. Demulsified Separation

Embodiments of the method comprise separating the demulsified hydrophobic phase from the demulsified aqueous phase 43, to create an aqueous product and an oil product 50, wherein the oil product 50 is suitable for reuse. In some embodiments of the method, the demulsified phases are separated by centrifugation. This may occur simultaneously with the demulsifying step, or it may occur subsequent to the demulsifying step. In some embodiments of the method, the demulsified aqueous phase 43 is separated from the demulsified hydrophobic phase by centrifuging in a two-phase centrifuge 9. In some embodiments of the method, the demulsified aqueous phase 43 is separated from the demulsified hydrophobic phase by centrifuging in a three phase centrifuge 10. If a three-phase centrifuge is used, a fourth fraction 53 of the drilling mud solid may be removed simultaneously. In some embodiments of the method, the fourth fraction 53 of the drilling mud solid removed comprises particles above a certain diameter. In various embodiments of the method, the diameter is one or more of the following: 0-100 μm, 0-75 μm, 0-50 μm, 0-25 μm, 0-20 μm, 0-15 μm, 0-10 μm, 100 μm, 75 μm, 50 μm, 25 μm, 20 μm, 15 μm, 10 μm, and about each of these values. The lower the diameter, the higher the quality of the oil product 50 and aqueous product will be. Higher diameters have the advantage of requiring less energetic centrifugation. In some embodiments of the method, substantially all solids are removed. In some embodiments the fourth fraction 53 of the drilling solids removed comprises particles above a certain density. In various embodiments of the method, the fourth fraction 53 of the drilling mud solid may comprise one or more of the following: a residual organic phase, and a residual aqueous phase.

In some embodiments of the method, the oil product 50 is suitable for reuse as a fuel, a drilling mud oil, or both. In some embodiments in which the oil product 50 is suitable for reuse as an oil, the oil product 50 is suitable as one or more of the following: a boiler fuel, a desorber fuel, and an oxidizer fuel. A desorber fuel is a fuel suitable to power a thermal desorber. An oxidizer fuel is a fuel suitable to power an oxidizer. A boiler fuel is a fuel suitable to power a boiler. It is generally advantageous that the oil product 50 have a low water content and a low solids content.

As the content of water decreases in the oil product 50, the energy yield of the fuel upon combustion increases. Acceptable diesel fuels can have relatively high water contents (up to about 40%) and still function as fuels for example in boilers. Various embodiments of the method produce oil products 50 with water contents of one or more of the following: 0-40%, 0-30%, 0-20%, 0-10%, 0-5%, below 5%, and about each of these values.

As the content of solids decreases, the energy yield of the fuel upon combustion increases and the ash production of combustion decreases. Fuels with high water or solids content have the advantage of low production cost. Various embodiments of the method create oil products 50 suitable as fuels with solids contents up to 20%, 15%, 6%, 1%, and about these values. In some embodiments of the method, the oil product 50 has a solids content of about 4-6%.

Embodiments of the method yield oil products 50 suitable for reuse in drilling muds with solids contents up to about 4-6%. In particular embodiments of the method, the oil product 50 suitable for reuse in drilling mud comprises a solids content of one or more of: 0-6%, 0-5%, 0-4%, 0-3%, 0-2%, 0-1%, 0%, and about each of these values.

The oil product 50 can be stored on-site in an oil storage facility 11, such as a tank 12. Alternatively, the oil product 50 can be delivered off-site by means such as tanker vehicles 13 or pipelines 14.

7. Vaporization of Residual Organics

Embodiments of the method comprise removing substantially all the residual organic phase from the solid fraction, to create an organic vapor and a first clean solid product 46, removing the residual organic phase comprising vaporizing the residual organic phase; wherein the first clean solid product 46 is substantially free from organic pollutants. Vaporization can be achieved by any means known by those skilled in the art. For example, it has been unexpectedly discovered that vaporization can be achieved very efficiently using a low-temperature thermal desorber 15. In some embodiments of the method, solid material separated from the waste drilling mud 44 is introduced to a thermal desorber, in which substantially all organic carbon is vaporized. In some embodiments, residual water associated with the solid fraction is co-vaporized. In some embodiments, water separated from the drilling mud is introduced and co-vaporized. The degree to which residual organic carbon is vaporized will be determined by various factors including residence time, temperature, pressure, and composition of the residual organic carbon.

The solid fraction may be any solid fraction that has been separated from the waste drilling mud 44 as described herein.

In embodiments in which organic carbon is vaporized in a thermal desorber 15, the thermal desorber can be of any type known to those skilled in the art. It has unexpectedly been discovered that residual organic carbon can be efficiently removed using a direct-fired counter-current low temperature thermal desorber 16. If a direct-fired thermal desorber 16 is used, some amount of the residual organic carbon is likely to be combusted, and the remainder vaporized.

In some embodiments of the method, the thermal desorber 15 is powered by a thermal desorber fuel, such as a combustible hydrocarbon fuel. In certain embodiments of the method, the oil product 50 is reused as the thermal desorber fuel. This approach has the advantage of both reusing the oil product 50 without creating any lasting pollutant and avoiding the need to purchase additional energy to power the desorber. Depending on the composition of the residual organics and depending on the operating conditions of the thermal desorber, a portion of the residual organic compounds may also serve as fuel in a direct-fueled thermal desorber 17. This has the advantage of requiring less input of energy from outside the process. In some embodiments of the method, the thermal desorber fuel is autoignited.

In various embodiments of the method, residual organics are vaporized using a direct-fired countercurrent thermal desorber 16 operating at one or more of the following temperatures: 500-650° F., 525-625° F., 550° F., or about these values. Higher temperatures have the advantage of ensuring complete vaporization and requiring shorter residence times, while lower temperatures have the advantage of less fuel consumption. In some embodiments, the thermal desorber 15 is operated at or about atmospheric pressure. In some embodiments, the thermal desorber 15 is operated at sub-atmospheric pressure. In various embodiments of the method the thermal desorber 15 is operated at one or more of the following pressures: 2-14" of water negative pressure, 4-12" of water negative pressure, 6-10" of water negative pressure, 8" of water negative pressure, or about these values. Residence time can also be varied to optimize vaporization, with longer residence times ensuring a better yield; shorter residence time provides for higher throughput.

8. Treatment and Disposal of the Solid Product

The solid product 46 created in the vaporization step may be combined with the solids collected from filtration of the gaseous product and the solids collected from cyclonic separation of the organic vapor; in such embodiments the solid product 46 comprises solids separated from the drilling mud, solids collected from filtration of the gaseous product and the solids collected from cyclonic separation of the organic vapor.

In some embodiments of the method, the solid product 46 is cooled and moistened by the addition of conditioning water. This may be achieved using a standard soil conditioner 18, for example. The conditioning water may comprise at least a portion of the aqueous phase (or the demulsified aqueous phase 43) of the waste drilling mud 44. The conditioning water may be saline groundwater. If the conditioning water is saline groundwater, then the solid product 46 will comprise a salt. The water may be used in any amount that will cool the solid product 46 for handling and condition the solid product 46 for particular uses. In some embodiments a portion of the water is discharged as steam.

Regardless whether the solid product 46 is treated, the solid products 46 of the method comprise no substantial amount of organic pollutant, and may be disposed of or reused without special measures. In some embodiments in which saline water is used to condition the solid product 46, the concentration of salt in the solid product 46 is sufficiently low that it does not constitute a pollutant.

9. Particulate Removal

In some embodiments of the method, particulate matter (such as evaporite, soot, or dust) is removed from the organic vapor and steam produced by the vaporization step. Removal may be achieved by any means known in the art. In some embodiments, cyclonic separation is used to efficiently collect the particulate matter. In such embodiments the characteristics of the cyclone may be varied to remove particulates based on density or size. In some embodiments of the method, removal is achieved using a dual cyclone 19. The dual cyclone 19 may comprise two cyclonic separators 20 in parallel, or in series. In additional embodiments more cyclonic separators 20 may be used. In some embodiments the solid particles are added to the solid product 46, either before or after the solid product 46 is cooled or conditioned.

10. Combustion of Organic Vapor

Embodiments of the method comprise combusting substantially all the organic vapor under conditions sufficient to ensure substantially complete combustion, to create a clean gaseous product. In some embodiments of the method, combustion is carried out in an oxidizer 20, for example by comingling the organic vapor with oxidizer fuel and an oxidant (such as $O_2$). Complete combustion can be achieved by varying conditions such as temperature, oxygen concentration, oxidizer fuel concentration, organic vapor concentration, residence time, and by adding various concentrations of atomized water. In various embodiments of the method, the temperature is maintained at one or more of the following temperatures: 1400-2000° F., 1500-1900° F., 1600-1800° F., 1700° F., and thereabouts. Oxygen concentration can be controlled by forcing air into the oxidizer using a blower or other means. Alternatively, concentrated or pure oxygen gas can be introduced into the oxidizer. Under conditions in which the concentration of organic vapor is high, it is desirable to increase the concentration of oxygen. In various embodiments of the method, the partial pressure of air in the oxidizer 20 is at least one of 12-20 psi, 13-19 psi, 14-18 psi, 15-17, 16 psi, and about these values. In various embodiments of the method, the partial pressure of oxygen in the oxidizer is at least one of 2.4-4.0 psi, 2.6-3.8 psi, 2.8-3.6 psi, 3.0-3.4 psi, 3.2 psi, and about these values. Under some conditions the oxidizer fuel will be ignited by autoignition.

Water may also be injected into the chamber. Waste water can be disposed of by vaporization this way, creating an aerosolized evaporite if the water contains solutes. Under some conditions it may be desirable to reduce the temperature in the oxidizer 20 by introducing water, for example atomized water. In some embodiments of the method the water comprises at least a portion of the aqueous phase (or demulsified aqueous phase 43). Introducing water also serves the purpose of disposing of saline water, the salt forming an evaporite upon vaporization of the water.

The oxidizer fuel can be any combustible gas or liquid, or even a fine combustible solid. In some embodiments of the method, the oxidizer fuel is the oil product 50. Using the oil product 50 as the oxidizer fuel has the advantage of reusing one of the products of the process on-site. It does not require that fuel be purchased and transported to the site. It provides a means of clean disposal of the oil product 50. The concentration of the oxidizer fuel in the oxidizer 21 will affect the efficiency of combustion. In various embodiments of the method the partial pressure of the oxidizer fuel in the oxidizer is one or more of the following: 120-240 psi, 140-220 psi, 160-200 psi, 180 psi, and thereabouts. High fuel concentrations have the advantage of providing higher temperatures and more complete combustion of the organic vapor. Low fuel concentrations have the advantage of preventing un-combusted fuel from leaving the oxidizer and low fuel consumption.

Depending on operating conditions, combusting the organic vapor may create a solid soot, dust, or aerosol, in addition to a clean gaseous product. The clean gaseous product may be substantially free from solids, organics, or pollutants at this point. Even a gaseous product that is substantially free from pollutants will likely contain a trace of carbon monoxide. The trace of carbon monoxide in some embodiments is below concentrations that are legally regulated; in other embodiments the trace of carbon monoxide is a legally regulated concentration that requires a discharge permit. In some embodiments the trace of carbon monoxide is less than 500 ppm, or about that amount.

11. Quenching

In some embodiments of the method, the clean gaseous product is cooled in a quench chamber 22. In certain of these embodiments, the quench chamber comprises a water inlet 23. The clean gaseous product may be cooled for example by spraying water into the quench chamber 22; the water will vaporize, cooling the gas. In some embodiments, the water is atomized water. In some embodiments, the water is saline water. In some embodiments of the method, the water is saline groundwater. In some embodiments of the method, the water comprises at least a portion of the aqueous phase (or the demulsified aqueous phase 43). If the water is saline, then a saline evaporite will be created upon vaporization of the water.

If a quench chamber 22 is used, it may be any type of quench chamber familiar to those skilled in the art. The quench chamber may facilitate cooling by expanding along its length, allowing the hot gas to expand and cool.

In embodiments of the method that involve a baghouse 24, the exit temperature of the clean gas product will be below about 400° F.; temperatures in this range have the advantage of not damaging the baghouse. In some embodiments of the method, the exit temperature will be above about 250° F.; temperatures in this range have the advantage of ensuring the quench water is fully vaporized. In various embodiments of the method, the exit temperature will be one or more of 250-400° F., 300-400° F., 325-375° F., 350° F. and about any of these values.

12. Filtration

In some embodiments of the method, the evaporite is captured subsequent to at least one of removing the residual organics or residual organic phase from the drilling mud solid fraction, oxidization of the organic vapor, or quenching of the clean gaseous product. The evaporite may be captured by any conventional separation method. In some embodiments of the method, the evaporite is captured by filtration. In certain of these embodiments, the evaporite is captured in a baghouse filter 25, in a baghouse 24.

13. Discharge

Embodiments of the method comprise discharging the clean gaseous product to create a clean gaseous discharge 45, wherein the clean gaseous discharge 45 is substantially free from solids, organics, or pollutants. The clean gaseous discharge 45 may contain traces of solids, organics, or pollutants. In some embodiments of the method, the clean gaseous discharge 45 contains no solids, organics, or pollutants at legally regulated levels. In some embodiments of the method, the clean gaseous discharge 45 contains carbon monoxide at a legally regulated level. In some embodiments, carbon monoxide is present below 500 ppm or about this value. In some embodiments of the method, at least one of the following is either absent or present below legally regulated levels: solids and organics.

We claim:

1. A method of treating a waste drilling mud comprising a bulk emulsion and a drilling mud solid, wherein the bulk emulsion comprises an organic emulsifier an hydrophobic phase and an aqueous phase, the method comprising:

(a) separating a fraction of the drilling mud solid from the waste drilling mud, the fraction comprising particles above a predetermined diameter;

(b) demulsifying the bulk emulsion by adjusting the pH of the waste drilling mud to 4.5-5.3, adding an oxidant sufficient to degrade said organic emulsifier, and heating the waste drilling mud to about 140-200° F., to break the emulsion and form a demulsified hydrophobic phase and a demulsified aqueous phase; and (c) separating the demulsified hydrophobic phase from the demulsified aqueous phase in a three-phase centrifuge, to create an aqueous product and an oil product, wherein the oil product comprises a water content and a solids content suitable for reuse.

2. The method of claim 1, comprising adjusting the viscosity of the drilling mud to below about 45 seconds Marsh funnel at 150°.

3. The method of claim 2, further comprising:

(a) vaporizing the aqueous phase;

(b) collecting an evaporite from the aqueous phase; and (c) vaporizing an aqueous residue from at least one fraction of the drilling mud solid, to form an aqueous vapor.

4. The method of claim 3, wherein collecting the evaporite further comprises separating the evaporite from the water vapor by filtration.

5. The method of claim 1, further comprising at least one step selected from the group consisting of: removing a second fraction of the drilling mud solids, wherein the second fraction comprises particles above a second pre-determined diameter; and removing a third fraction of drilling mud solids to create a reusable oil product, wherein the third fraction comprises particles above a third diameter.

6. The method of claim 5, comprising centrifuging the waste drilling mud in a decanter centrifuge to remove at least one of said second or third fraction.

7. The method of claim 5, wherein demulsification, separation of the hydrophobic phase from the aqueous phase, and removal of the third fraction are at least partially achieved by centrifuging the waste drilling mud in the three-phase centrifuge.

8. The method of claim 1, wherein the reusable oil product is suitable for use as a fuel or as a component in a drilling mud.

* * * * *